United States Patent [19]

Grotenhofer

[11] Patent Number: 5,051,033

[45] Date of Patent: Sep. 24, 1991

[54] BRACING DEVICE FOR A SELF-ADVANCING SHIELD TUNNELLING MACHINE

[75] Inventor: Heinrich Grotenhofer, Krefeld, Fed. Rep. of Germany

[73] Assignee: Gebr. Eickhoff Maschinenfabrik und Eisengieberei mbH, Fed. Rep. of Germany

[21] Appl. No.: 567,637

[22] Filed: Aug. 15, 1990

[30] Foreign Application Priority Data

Aug. 26, 1989 [DE] Fed. Rep. of Germany ..... 3928342

[51] Int. Cl.[5] ..... E21D 9/06

[52] U.S. Cl. ..... 405/147; 405/142; 405/141

[58] Field of Search ..... 405/141, 142, 146, 147, 405/289, 291

[56] References Cited

U.S. PATENT DOCUMENTS

| | | | |
|---|---|---|---|
| 3,788,087 | 1/1974 | Patin | 405/141 |
| 4,124,985 | 11/1978 | Maimets | 405/289 X |
| 4,334,800 | 6/1982 | Stuckmann | 405/141 X |
| 4,355,924 | 10/1982 | Hüsemann et al. | 405/141 X |
| 4,558,906 | 12/1985 | Takamiya et al. | 405/141 X |
| 4,773,792 | 9/1988 | Landers | 405/289 X |

*Primary Examiner*—Dennis L. Taylor
*Assistant Examiner*—J. Russell McBee
*Attorney, Agent, or Firm*—Clifford A. Poff

[57] ABSTRACT

A bracing device for a self-advancing shield tunnelling machine for tunnel construction comprising a control shield within which is mounted a cutting unit, and at least two bracing shields each having a closed circumferential wall construction which are connected together by feed cylinders, the bracing shields being able to be radially braced with the tunnel wall independently of each other by bracing elements fixed thereon. The bracing elements are composed of elastic pressure hoses positioned around the closed circumferential bracing shield walls. The circumferences of the bracing elements can be continually enlarged by expansion, particularly by inflation. The invention furthermore relates to the use of such bracing elements for a self-advancing shield tunnelling machine in which the control shield and the first bracing shield arranged behind it as well as the first and second bracing shield engage in each other and overlap telescopically. The first bracing shield is connected at a first end thereof to the control shield and, at a second end thereof, to the second bracing shield via independently actuatable piston and cylinder units.

24 Claims, 2 Drawing Sheets

BRACING DEVICE FOR A SELF-ADVANCING SHIELD TUNNELLING MACHINE

BACKGROUND OF THE INVENTION

1. Field of the Invention: The present invention relates generally to a bracing device for a self-advancing shield tunnelling machine for tunnel construction and, more particularly, to a bracing device which is composed of a control shield within which is mounted a cutting unit, and at least two bracing shields which are connected together by feed cylinders, the bracing shields being able to be radially braced with the tunnel wall independently of one another by bracing elements which are fixed thereto.

2. Description of the Prior Art: In tunnel construction, shield machines are usually driven with tubbing support of sliding lagging, and in canal construction, especially in an inaccessible area, by tube driving. In the typical tunnel construction process, the advancing of the machine occurs via feed cylinders which are supported on the newly produced tunnel lining or tubbing. The machine direction control normally occurs via operation of the feed cylinders or via special piston valve cylinders, through which operation an articulatedly connected control shield is moved forward in the desired direction.

In known shield machines in which the bracing required for advancement of the machine is carried out in an area in which there is not yet any tubbing, bracing typically occurs by radially outwardly movable single elements or by expanding shields which form movable parts of the shield wall construction. As a result of the necessary relative movement between the moving and fixed elements of the shield wall construction, gaps are formed between the moving and fixed elements through which leakages may easily occur. Shield machines with radially movable bracing elements frequently have advancing mechanisms which possess two shields or bracing members, namely, one bracing member in which is mounted a boring head that is moved forwardly out of the shield via feed cylinders, and a second bracing member which serves to advance the first bracing plane. The second bracing member, for its part, can also be drawn up over the first bracing member. It is also known for areas to be provided between the bracing members in which the shields telescopically overlap. Such machines, which are most suitable for use in stable ground (particularly hard rock) there is a danger of holing occurring immediately behind the boring head and in front of the first shield if the machines are used in loose, friable and flexible ground. If these machines are used in unstable ground, it is necessary to advance the first bracing unit together with the boring head via the second bracing unit.

An advantage exists, therefore, for a self-advancing shield tunnelling machine having bracing elements of uncomplicated construction which prevent the occurrence of gaps and leakages when the bracing elements are radially outwardly extended.

A further advantage exists for a self-advancing shield tunnelling machine having first and second brace members which will permit a boring head supported by the first brace member to be advanced independently of the first brace member.

It is therefore an object of the present invention to provide bracing elements for a self-advancing shield tunneling machine wherein the bracing elements are of uncomplicated construction and prevent the occurrence of gaps and leakages when the bracing elements are radially outwardly extended.

It is a further object of the present invention to provide a self-advancing shield tunneling machine having first and second bracing members which will permit a boring head supported by the first brace member to be advanced independently of the first brace member.

Still other objects and advantages of the present invention will become apparent in light of the attached drawings and written description of the invention presented herebelow.

SUMMARY OF THE INVENTION

According to the present invention, novel bracing elements are provided on at least the first and second bracing shields of a self-advancing shield tunnelling machine. The bracing elements are composed of elastic pressure hoses whose circumference can be continually enlarged particularly by inflation, which are placed around bracing shields having closed-wall shield constructions, i.e., a shield construction wherein the circumferential walls of the shield are essentially closed and do not possess any radially extendable parts. Expansible bracing elements, per se, form part of the prior art; however they are used as activatable seals and as gripper elements, e.g., for retaining two tubes which can be moved telescopically towards each other in the case of lift units and pile-driving tools. Unlike the bracing elements of prior shield tunnelling machines, the bracing elements of the present invention form a system which is closed in itself and is placed around the closed-wall shield construction, so that the shield itself has no openings and gaps which have to be sealed upon activation of the bracing elements.

The invention provides for the elastic pressure hoses to be placed between radially outwardly projecting flanges which may be fixedly or releasably attached to the outer wall of the shield construction. The hoses may be composed of thick-walled hoses whose outer circumference can be provided with thickenings which press into the tunnel wall. Furthermore, the thick-walled pressure hoses can have lateral thickenings, preferably in the form of barbs, which engage generally behind the radially outwardly projecting flanges.

Another embodiment of the invention provides for the elastic hoses to be composed of thin-walled hoses about each of which a ring of elastic material is arranged.

In order to prevent shifting of the bracing elements, the invention provides for each of the elastic pressure hoses and the ring of elastic material to be arranged between two of the aforementioned encircling radially projecting flanges which are fixed to the outside of the shield construction. As noted above, the flanges can be detachably fastened to the construction, for example, by screw connections. According to the invention, the elastic pressure hoses are provided with valves which are fastened in the wall of the shield construction and can be actuated from its interior space. The invention makes it possible to combine as many bracing elements as desired into one unit. The bracing elements can be used both for bracing in tunnels of circular cross-section and also any other types of tunnel cross-sections.

The construction of the self-advancing shield tunnelling machine of the present invention also makes it possible to advance the boring head, which is carried within a protective control shield, to be advanced in accompaniment with the control shield independently of the first bracing member.

Still further, the present invention involves the use of the aforementioned bracing elements in a self-advancing shield tunnelling machine for tunnel construction having a control shield which carries the boring head, and at least two bracing shields which are equipped with the bracing elements. The control shield and the first and the second bracing shields arranged behind it engage in each other and overlap telescopically. The first bracing shield is connected to the control shield and to the second bracing shield via piston-cylinder units which can be actuated independently of each other. If necessary, a support shield can be similarly connected to the second bracing shield with a similar telescopic overlapping.

DESCRIPTION OF THE PREFERRED EMBODIMENTS

Figure 1:
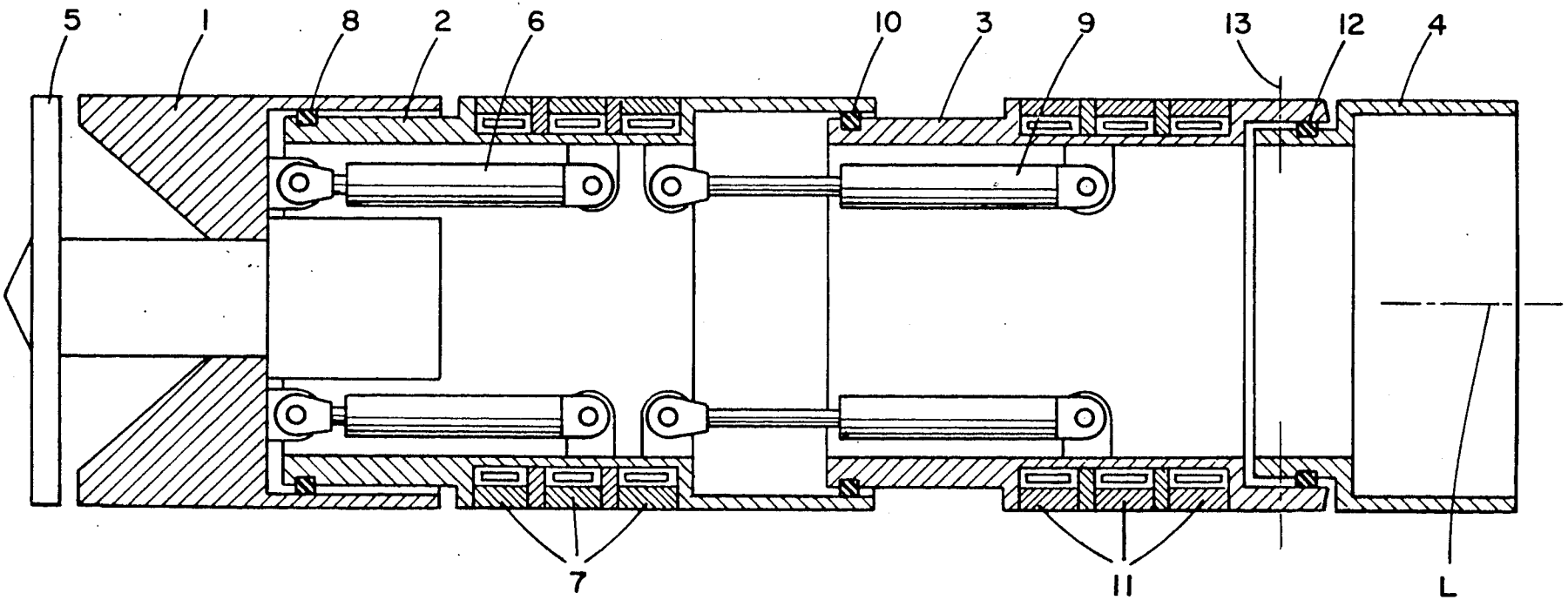
FIG. 1 is longitudinal sectional view of the shield tunnelling machine of the present invention.

The tunnelling machine shown in FIG. 1 is comprised of a control unit 1, a first bracing shield 2, a second bracing shield 3 and a support unit 4, which are arranged one behind the other along the same longitudinal axis L. Mounted within the control shield 1 is a cutting unit 5, e.g. a cutting wheel, which is caused to rotate in the known manner and which loosens the material being bored. The loosened material is conveyed away by conveying equipment, e.g. a conveyor belt (not illustrated), through the interior space of the machine.

The advancing of the control shield 1 occurs via extendable and retractable mechanisms, such as, for example feed cylinders 6, which are supported in the front bracing shield 2. Front bracing shield 2 is provided with bracing elements 7 to be described in greater detail hereinbelow.

FIG. 1 further shows that the front section of the cylindrical bracing shield 2, as seen in the advancing direction, has a reduced diameter, so that it can be telescopically inserted into the control shield 1. The gap formed in the area of the overlapping is sealed with a seal 8. In the case of the exemplified embodiment, the control of the control shield 1 occurs via the front feed cylinders 6. Control can also occur via separate control cylinders and an auxiliary joint between the two shields.

The second bracing shield 3 is preferably constructed in an identical manner to shield 2 and contains feed cylinders 9 which are also connected to the bracing shield 2. The rear end of the bracing shield 2 and the front end of the bracing shield 3 likewise engage in each other telescopically and the gap which is formed in the overlapping area is sealed with a seal 10. The bracing shield 3 is provided with bracing elements 11. A support shield, herein designated by the numeral 4, engages telescopically in the rear end of the shield 3 with seals 12 being placed in the area where they overlap. Shields 3 and 4 are connected together in articulated manner by a joint is indicated by dotted lines 13, in order to make it possible for the support shield 4 to follow the controlling movements of the control shield and to traverse curve radii. The support of the tunnel cross-section rearwardly of the support shield 4 can occur by way of single segments or continuously, e.g. by ribbon-like material or with the aid of a conventional extruding process.

A first method of operating the device is as follows: Let is be first assumed that the front advancing cylinders 6 have been fully extended. In such a condition, the front bracing shield 2 must then be shifted. To this end, the bracing elements 7, which were radially extended into a bracing position for the advancement of the control shield 1 are first released. Subsequently, the bracing shield 3 is braced in the ground with the aid of the bracing elements 11, and the front bracing shield is advanced via the front advancing cylinders 6. This situation is illustrated in FIG. 1. After the front bracing shield 2 has been advanced, the rear bracing shield must then be advanced. For this purpose, the bracing elements are braced in the front bracing shield 2 and released in the rear bracing shield 3 and the rear bracing shield is advanced. The support shield 4, which is articulately connected to rear bracing shield 3, is then also drawn up together with the rear bracing shield 3. Alternatively, simultaneous with the advancement of the rear bracing shield, the control shield 1 can also be advanced whereby it is possible to propel the support 4 during boring.

The tool arrangement according to the present invention also provides two further advantageous possibilities, namely, the advance of the control shield 1 via both bracing shields in the event that especially great advancing forces are necessary and the surrounding ground is very flexible in the area of the bracing shields, and a continuous advance rate.

During advancement via both bracing shields, both the front and rear bracing shields are braced, so that they both act as abutments for the front advancing cylinders 6. After propulsion of the control shield 1, first the front bracing shield, and then the rear bracing shield situated behind it, are shifted. Obviously, simultaneous support and propulsion of the machine during cutting is not possible with this mode of operation.

In continuous advancement, the control shield 1 and the cutting unit 5 carried thereby are first advanced by the cylinders 6 associated with the front bracing shield 2. At the instant the control shield 1 becomes fully advanced, the cylinders 9 are activated so as to advance the front bracing shield 2, thereby also advancing the control cylinder 1 (and cutting unit 5). Concurrently with the extension of cylinders 9, however, cylinders 6 are caused to retract, but at a lower speed than the extension rate of cylinders 9 so that continuous advancement of the machine, and continuous cutting, is maintained. At the instant cylinders 9 are fully extended, the retracted cylinders 6 are again activated, and the cycle is repeated. In such a mode of operation, no cutting time is lost due to the advancement of the bracing shields. However, in this situation, the support provided by the front bracing shield can occur merely at the time when the control shield is advanced via the front bracing shield.

Figure 4:
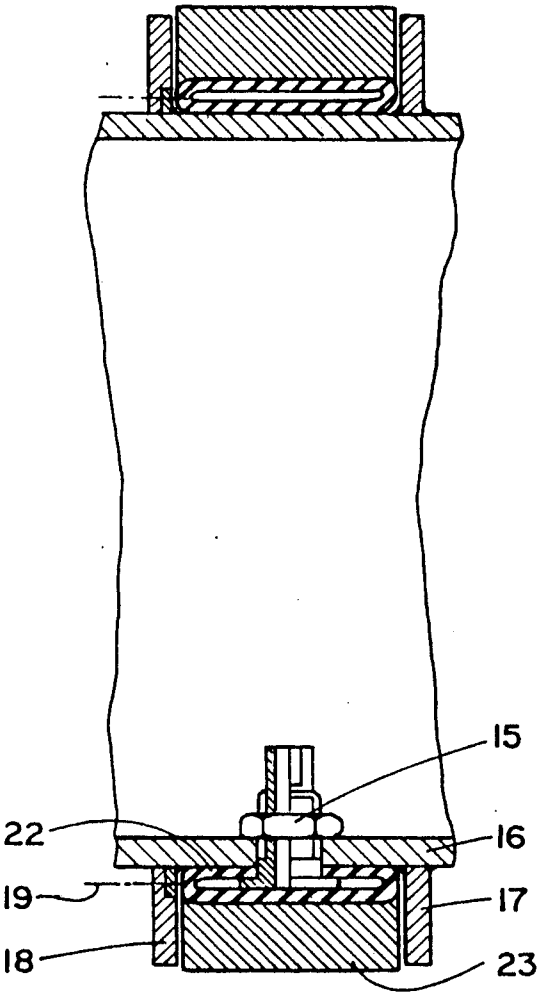
FIGS. 3 and 4 are views similar to FIG. 2 and illustrate further embodiments of a bracing element in accordance with the present invention.
Figure 3:
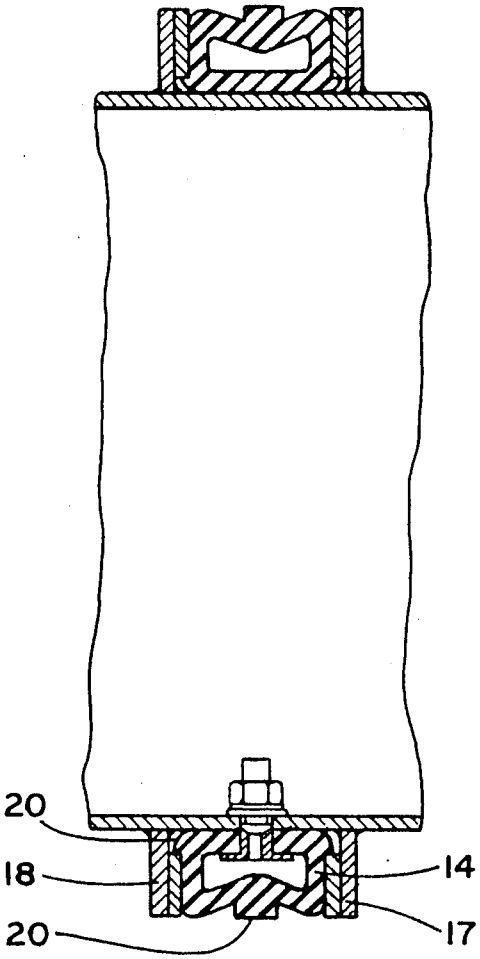
Figure 2:
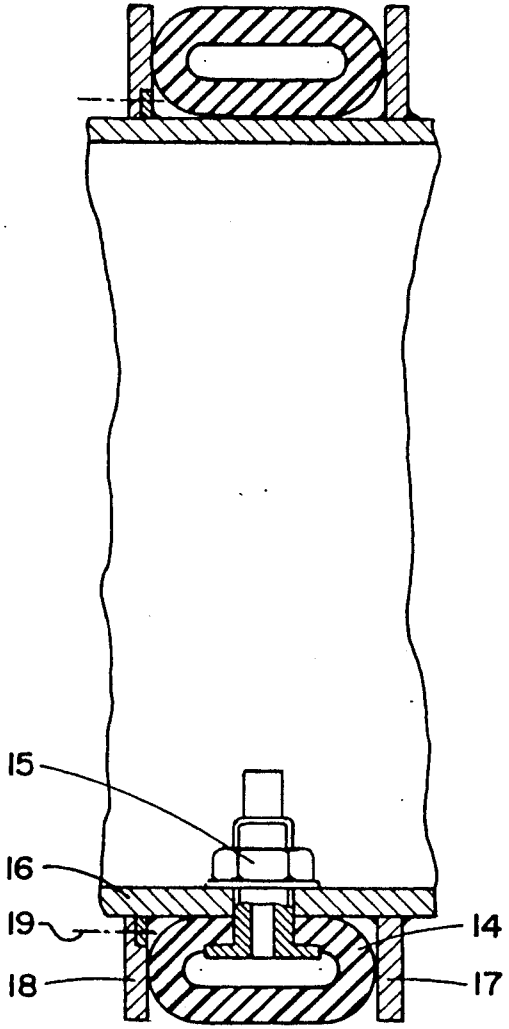
FIG. 2 is an enlarged longitudinal section through a bracing shield of the machine depicted in FIG. 1 taken in the region of a bracing element.

In FIGS. 2, 3 and 4 there are illustrated several preferred embodiments for the advantageous construction of the bracing elements 7, 11 which, according to the invention, are used in conjunction with the shield tunnelling machine. Each of these drawings represents one bracing element of the sets of three bracing elements 7 and 11 illustrated in FIG. 1, which are used for each shield. It is possible that more or less than three bracing elements 7, 11 may be provided for each bracing shield, if such is desired or necessary. In each embodiment, the bracing element is basically composed of an elastic pressure hose whose circumference can be continually enlarged by inflating which is placed around the closed-wall shield construction. According to the embodiment shown in FIG. 2, a thick-walled hose 14 is used, into which is inserted a valve 15 which is fastened in the otherwise closed circumferential wall 16 of the shield construction and is accessible from its interior space. In each embodiment, the pressure hose 14 is arranged between two encircling flanges 17 and 18 extending in radial direction which are fastened to the outside of the closed-wall shield construction. The fastening of the flanges can occur by a welded connection, as illustrated in regard to the flange 17. The flanges can, however, also be releasably fastened by a screw connection which is indicated by the dotted line 19 illustrated in regard to the flange 18 in FIGS. 2 and 4.

In the embodiment illustrated in FIG. 3, the thick-walled hose 14 is provided with laterally projecting thickenings in the form of barbs 20, which grip behind undercuts in the flanges 17 and 18. With the numeral 21 there is indicated a thickening at the outer circumference of the hose 14 which serves to dig into the tunnel wall surrounding the shield, thereby enhancing the transmittal of the axial shearing forces created during advancement of the various machine components.

In the embodiment illustrated in FIG. 4, wherein corresponding elements have been provided with the same reference numbers as their counterparts in FIGS. 2 and 3, a thin-walled pressure hose 22 is used instead of a thick-walled hose. A ring 23 of elastic material is arranged between the two flanges 17 and 18 and surrounds the outer circumference of the thin-walled pressure hose 22 for transmitting to the wall surrounding the bracing element the pressure which occurs when the pressure hose is expanded. It is also possible that conventional bracing units, e.g., bracing claws, may be used in place of the ring of elastic material 23 around the thin-walled pressure hose 22.

With the bracing elements constructed according to the invention, large bracing surfaces can be obtained, since as many bracing elements as desired can be combined into one shield unit. Moreover, the expansible type of bracing disclosed herein can be used for circular or for any other tunnel cross-sectional shapes.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A self-advancing shield tunnelling machine, said machine comprising:

at least two bracing shields arranged along a common longitudinal axis, each of said bracing shields having a substantially closed circumferential wall construction;

means connecting said bracing shields to one another for causing relative movement between adjacent ones of said bracing shields; and at least one elastic pressure hose bracing element positioned around the substantially closed circumferential wall construction of each of said bracing shields, said at least one bracing element of one of said bracing shields being independently inflatable of said at least one bracing element of an adjacent one of said bracing shields wherein the bracing shields can be radially braced with a tunnel wall independently of one another.

2. The machine of claim 1 wherein said at least one elastic pressure hose bracing element comprises at least one relatively thick-walled hose.

3. The machine of claim 2 wherein said at least one relatively thick-walled hose is provided on its outer circumference with thickening of material for pressing into the tunnel wall upon sufficient inflation of said relatively thick-walled hose.

4. The machine of claim 1 further comprising a plurality of spaced-apart radially extending encircling flanges secured to the exterior of the substantially closed circumferential wall construction of each of said bracing shields, at least two of said plurality of flanges receiving therebetween said at least one bracing element.

5. The machine of claim 2 further comprising a plurality of spaced-apart radially extending encircling flanges secured to the exterior of the substantially closed circumferential wall construction of each of said bracing shields, at least two of said plurality of flanges receiving therebetween said at least one bracing element.

6. The machine of claim 5 wherein said at least one relatively thick-walled hose is provided with lateral thickenings for engaging with undercuts formed in said flanges.

7. The machine of claim 1 wherein said at least one elastic pressure hose bracing element comprises at least one relatively thin-walled hose about which a ring of elastic material is arranged.

8. The machine of claim 4 further comprising means for releasably securing said flanges to said substantially closed circumferential wall construction.

9. The machine of claim 1 wherein said elastic pressure hose bracing elements include valve means fastened in the substantially closed circumferential wall constructions of said bracing shields for permitting inflation of said bracing elements from interior spaces of said bracing shields.

10. The machine of claim 1 wherein said means for causing relative movement between adjacent ones of said bracing shields comprise extendable and retractable mechanisms.

11. The machine of claim 10 further comprising:

a control shield connected to a forwardmost one of said bracing shields;

means connecting said control shield to said forwardmost bracing shield for causing relative movement between said control shield and said forwardmost bracing shield; and earth cutting means carried by said control shield so as to be movable therewith.

12. The machine claim 11 wherein said means for causing relative movement between said control shield and said forwardmost bracing shield comprise extendable and retractable mechanisms.

13. The machine of claim 12 wherein said control shield is telescopically coupled to said forwardmost bracing shield and adjacent ones of said bracing shields are telescopically coupled to one another.

14. The machine of claim 13 wherein said means for causing relative movement between said control shield and said forwardmost bracing shield are actuatable independently of said means for causing relative movement between adjacent ones of said bracing shields.

15. The machine of claim 12 further comprising a support shield telescopically coupled to a rearwardmost one of said bracing shields.

16. Bracing elements for a self-advancing shield tunnelling machine having a control shield carrying a cutting unit and at least two bracing shields connected together by feed cylinders, said bracing shields being radially braceable with a tunnel wall independently of each other by said bracing elements which are fixed thereto, the improvement comprising an assembly wherein said bracing elements provided on said bracing shields are independently actuatable elastic pressure hoses whose circumferences can be enlarged by inflation and which are positioned around a substantially closed circumferential wall construction of each of said bracing shields.

17. The bracing elements of claim 16 wherein the elastic pressure hoses comprise relatively thick-walled hoses.

18. The bracing elements of claim 17 wherein said relatively thick-walled hoses are provided on outer circumferences thereof with thickenings for pressing into the tunnel wall upon sufficient inflation of said thick-walled hoses.

19. The bracing elements of claim 16 wherein at least one of said bracing elements is arranged between two of a plurality of radially extending encircling flanges secured to the exterior of the substantially closed circumferential wall construction of each of said bracing shields.

20. The bracing elements of claim 17 wherein at least one of said bracing elements is arranged between two of a plurality of radially extending encircling flanges secured to the exterior of the substantially closed circumferential wall construction of each of said bracing shields.

21. The bracing elements of claim 20 wherein said relatively thick-walled hoses are provided with lateral thickenings for engaging with undercuts formed in said flanges.

22. The bracing elements of claim 16 wherein said elastic pressure hoses comprise relatively thin-walled hoses about each of which a ring of elastic material is arranged.

23. The bracing elements of claim 16 wherein said elastic pressure hoses include valve means fastened in the substantially closed circumferential wall constructions of said bracing shields for permitting inflation of said hoses from interior spaces of said bracing shields.

24. A method for operating a self-advancing shield tunnelling machine including first and second bracing shields adapted to bracingly engage the wall of a tunnel and a control shield carrying an earth cutting device, said control shield being telescopically coupled to a first end of said first bracing shield and said second bracing shield being telescopically coupled to a second end of said first bracing shield opposite said first end thereof, said method comprising the steps of:

using said first bracing shield to advance said control shield and said earth cutting device together as a unit; and using said second bracing shield to advance said first bracing shield.

* * * * *